US010538379B2

(12) United States Patent
Weissbrod

(10) Patent No.: US 10,538,379 B2
(45) Date of Patent: Jan. 21, 2020

(54) WELDING WIRE COIL PACKAGE

(71) Applicant: LINCOLN GLOBAL, INC., City of Industry, CA (US)

(72) Inventor: Paul A Weissbrod, South Euclid, OH (US)

(73) Assignee: LINCOLN GLOBAL, INC., City of Industry, CA (US)

( * ) Notice: Subject to any disclaimer, the term of this patent is extended or adjusted under 35 U.S.C. 154(b) by 830 days.

(21) Appl. No.: 14/272,448

(22) Filed: May 7, 2014

(65) Prior Publication Data

US 2015/0259131 A1 Sep. 17, 2015

Related U.S. Application Data

(60) Provisional application No. 61/951,173, filed on Mar. 11, 2014.

(51) Int. Cl.

| | |
|---|---|
| ***B65D 85/04*** | (2006.01) |
| ***B65H 55/04*** | (2006.01) |
| ***B65B 25/24*** | (2006.01) |
| ***B65B 11/04*** | (2006.01) |

(Continued)

(52) U.S. Cl.

CPC ..... *B65D 85/04* (2013.01); *B65B 11/04* (2013.01); *B65B 25/24* (2013.01); *B65D 53/02* (2013.01); *B65H 55/046* (2013.01); *B65B 25/148* (2013.01); *B65H 2701/36* (2013.01)

(58) Field of Classification Search

CPC ..... B65D 85/04; B65D 85/67; B65D 85/671; B65D 85/672; B65D 85/675; B65D 85/676; B65H 55/04; B65H 55/046; B65H 55/00; B65H 55/02; B65H 75/148; B65H 75/145; B65H 2402/443; B65H 49/36

USPC ..... 206/409, 413, 389, 397, 398, 400, 401, 206/407, 410, 411, 414; 242/163, 171, 242/178, 596, 129.62, 129.72, 129.71, 242/137.1, 140, 129.6, 129.5, 157 R, 242/615.3

See application file for complete search history.

(56) References Cited

U.S. PATENT DOCUMENTS

| | | | | |
|---|---|---|---|---|
| 1,989,931 A | | 2/1935 | Johnson | |
| 2,596,970 A | * | 5/1952 | Adams ..... | B65D 85/04 242/170 |
| 2,720,309 A | | 6/1953 | Kimball | |

(Continued)

FOREIGN PATENT DOCUMENTS

| | | |
|---|---|---|
| CA | 2385620 A1 | 5/2002 |
| CA | 2520484 C | 3/2006 |

(Continued)

OTHER PUBLICATIONS

International Search Report and Written Opinion for PCT/IB2015/000310 dated Nov. 12, 2015.

(Continued)

*Primary Examiner* — Allan D Stevens
(74) *Attorney, Agent, or Firm* — Foley & Lardner LLP

(57) ABSTRACT

A welding wire coil package system for a coil of wire including a sheath that is laid over the coil where the sheath includes at least one layer of material that adheres to the wire to hold the wire within the coil in the position that the coil is formed and prevent unintended movement of the wire, the sheath defining an opening through which wire is paid out from an interior surface of the coil.

14 Claims, 14 Drawing Sheets

(51) Int. Cl.
*B65D 53/02* (2006.01)
*B65B 25/14* (2006.01)

(56) References Cited

U.S. PATENT DOCUMENTS 2,973,911 A 3/1961 Rayburn
3,457,962 A * 7/1969 Shobert ..... A63B 53/10 138/125
3,672,586 A 6/1972 Morton
3,689,005 A * 9/1972 Newman ..... B65D 85/676 242/163
3,695,529 A 10/1972 Hori et al.
3,747,746 A * 7/1973 Newman ..... B65D 75/004 206/409
3,747,861 A 7/1973 Wagner et al.
3,748,817 A 7/1973 Newman
3,803,796 A 4/1974 Newman et al.
3,878,940 A * 4/1975 Wittebort ..... B65D 85/671 206/416
3,915,301 A 10/1975 Gray et al.
3,985,315 A * 10/1976 Newman ..... B65D 83/00 242/163
4,300,734 A 11/1981 Green et al.
4,348,439 A 9/1982 Jones
4,467,916 A 8/1984 Hedden
4,541,222 A 9/1985 Joly
4,602,747 A 7/1986 Turk et al.
4,741,495 A 5/1988 Kotzur
4,911,299 A * 3/1990 Peeters ..... G03C 3/00 206/410
4,993,650 A 2/1991 Nickell
5,147,040 A 9/1992 Koike et al.
5,203,139 A 4/1993 Salsburg et al.
5,238,114 A 8/1993 Irozuru
5,470,026 A 11/1995 Kotzur
5,499,775 A 3/1996 Vander Groef
5,678,778 A 10/1997 Kotzur et al.
5,803,397 A 9/1998 Kotzur et al.
5,810,272 A 9/1998 Wallace et al.
5,938,260 A 8/1999 Wallace et al.
5,941,387 A * 8/1999 Rasel ..... G03C 3/00 206/413
6,086,012 A * 7/2000 Kotzur ..... B65D 5/5028 206/395
6,109,554 A 8/2000 Kotzur et al.
7,036,663 B2 * 5/2006 Itkonen ..... B65B 11/008 206/410
7,249,726 B2 7/2007 Kotzur
8,056,717 B2 11/2011 Weissbrod
8,191,337 B2 6/2012 Moore
8,302,894 B2 11/2012 Mercuri et al.
2001/0037955 A1 11/2001 Pienta
2011/0248112 A1 10/2011 Corbett et al.
2012/0110955 A1 5/2012 Rekieta et al.
2014/0158802 A1 * 6/2014 Batchelder ..... B65H 49/02 242/163

FOREIGN PATENT DOCUMENTS

DE 93 04 380 U1 5/1993
DE 44 05 187 A1 9/1994
EP 1997761 A2 12/2008
EP 2 308 775 A1 4/2011
GB 566341 A 12/1944
GB 814912 A 6/1959
JP 2004106938 A 4/2004
JP 2009-23733 A 2/2009
KR 20040105196 A 12/2004
WO WO2013017694 A1 2/2013

OTHER PUBLICATIONS

Filament Winding, Springer, Handbook of Composities, 1982, pp. 449-478.

* cited by examiner

WELDING WIRE COIL PACKAGE

This application claims priority to and the benefit of U.S. Provisional Patent Application 61/951,173, filed on Mar. 11, 2014.

TECHNICAL FIELD

The present invention generally relates to a welding wire coil package. More particularly, the present invention relates to a welding wire coil having at least a first turn and a second turn that overlap each other at a cross over point forming a figure eight configuration. Most particularly, the welding wire coil package includes such a coil that includes a sheath and end forms attached to the exterior of the coil to prevent inadvertent or unintended movement wire coils relative to each other during transport or handling of the coil.

SUMMARY OF THE INVENTION

The present invention provides a welding wire coil package system for a coil of wire including a sheath that is laid over the coil where the sheath includes at least one layer of material that adheres to the wire to hold the wire within the coil in the position that the coil is formed and prevent unintended movement of the wire, the sheath defining an opening through which wire is paid out from an interior surface of the coil.

The present invention further provides a welding wire coil formed from a length of wire having successive turns that overlap each other at one or more cross over point, where the coil has an inner surface that defines a hollow interior and an outer surface, the coil also has a first end and a second end, a sheath attached to the outer surface of the coil, and a first end form that abuts the first end of the coil and a second end form that abuts the second of the coil, wherein the first end form and second end form each include a capture portion that extends axially inward and overlies a portion of the outer surface of the coil, and wherein the sheath includes an end form sheath portion that overlies each capture portion and attaches the capture portion to the sheath.

The present invention further provides a welding wire coil package including a length of welding wire wound to include at least a first turn and a second turn that overlap each other at a cross over point, wherein the first turn and the second turn define a gap on one side of the coil, the coil having an interior surface that defines a hollow bore and an exterior surface; a first end form at a first end of the coil and a second end form at a second end of the coil, wherein each end form includes an edge portion that abuts an end of the coil and an extended element that extends radially outward from the edge portion and terminates in a flange; a shell that overlies the exterior surface of the coil and attaches to each end form.

The following description and the annexed drawings set forth in detail certain illustrative aspects of the claimed subject matter. These aspects are indicative, however, of but a few of the various ways in which the principles of the innovation may be employed and the claimed subject matter is intended to include all such aspects and their equivalents. Other advantages and novel features of the claimed subject matter will become apparent from the following detailed description of the innovation when considered in conjunction with the drawings.

DETAILED DESCRIPTION OF THE INVENTION

As used herein, spatially orienting terms such as "above," "below," "upper," "lower," "inner," "outer," "right," "left," "vertical," "horizontal," "top," "bottom," "upward," "downward," "laterally," "upstanding," et cetera, can refer to respective positions of aspects as shown in or according to the orientation of the accompanying drawings. "Inward" is intended to be a direction generally toward the center of an object from a point remote to the object, and "outward" is intended to be a direction generally away from an internal point in the object toward a point remote to the object. Such terms are employed for purposes of clarity in describing the drawings, and should not be construed as exclusive, exhaustive, or otherwise limiting with regard to position, orientation, perspective, configuration, and so forth.

Figure 12:
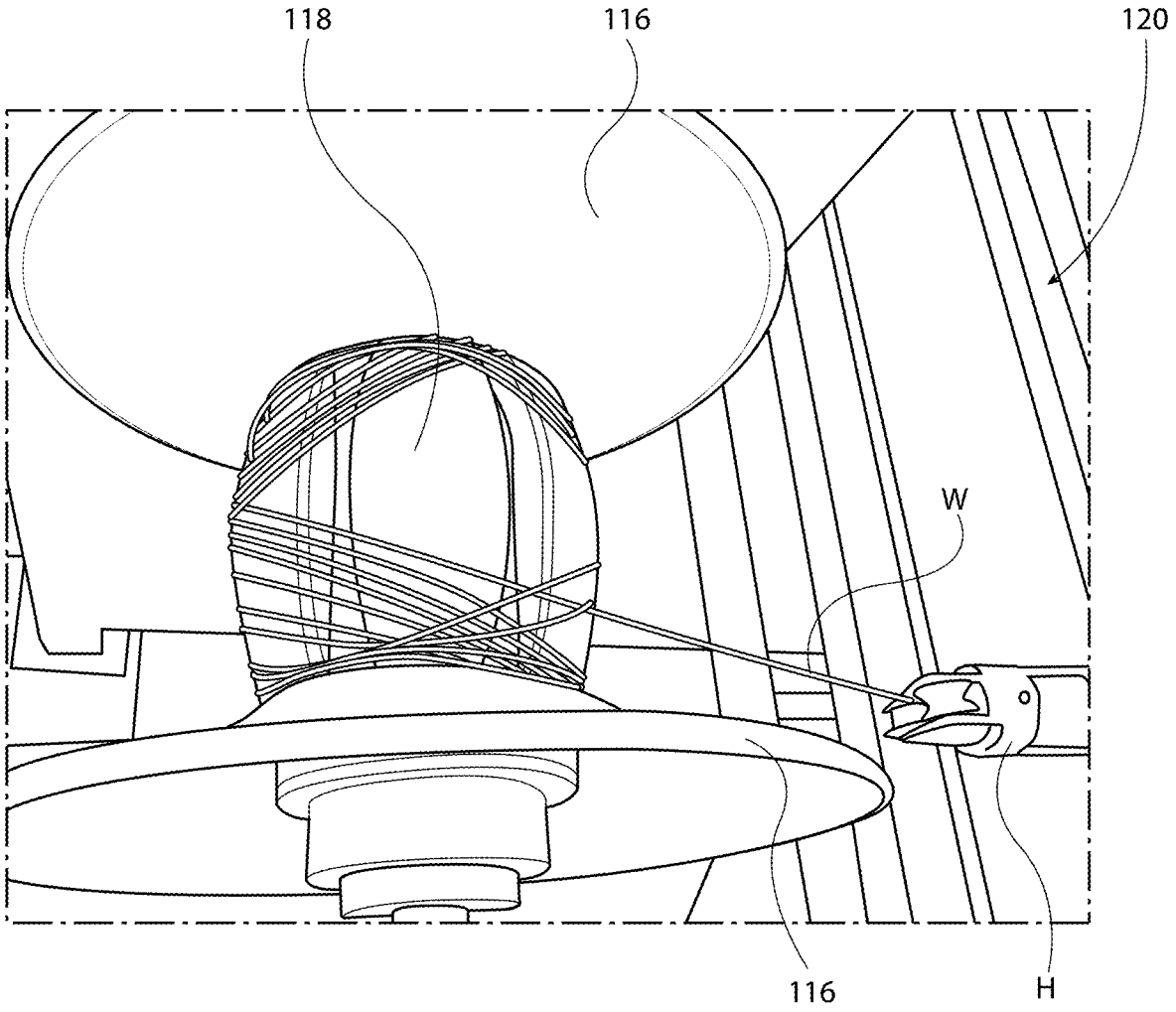
FIG. 12 is a perspective view of a welding wire coiling system having a wire guide.

The present invention generally provides a welding wire coil package that includes a pair of end forms and a sheath that encapsulate a welding wire coil 10. Other aspects of the invention relate to the process of forming the coil 10. To form a coil 10, the length of wire is formed into successive turns. These turns may have any shape including but not limited to the generally circular shape shown. The shape of the turns and coil may be defined with or without a mandrel or other form. It will be appreciated that if a form is used to define the turn and coil shape, the form may be a single member or formed from multiple members. In addition forms having a single surface that defines the shape of the turn or coil including but not limited to cylindrical or polygonal surfaces may be used (e.g., at least one of the first end form 71 or second end form 72 can have a cylindrical surface.). Alternatively, the form may be skeletal and include points of contact that define the shape of the turn or coil (FIG. 12).

In the example shown, a coil 10 having a single length of welding wire W. The length is formed into at least one first turn 11 and at least one second turn 12. The first turn 11 and second turn 12 are wound such that the second turn 12 overlies the first turn 11 at a cross over point CP. Additional turns may be applied as discussed below to build up a coil 10. Coil 10 includes an outer surface 14, an inner surface 15, a first end 16 and a second end 17.

The length of wire W extends in a first direction to form first turn 11 and then the direction is reversed to cross over first turn 11 and form second turn 12. Forming the length of wire in a first turn by extending in a first direction applies a first twist to the length of wire and reversing the direction of the wire applies an opposite twist to the welding wire such that the net effect is to form a welding wire coil 10 having a neutral twist or an effective twist of zero. The twist may be applied to a welding wire that is pre-cast and has been elastically deformed. As in the example shown, the twist does not need to plastically deform the welding wire. There may be instances where it is desirable to plastically deform the welding wire when applying the twist, and this could be accomplished by selecting the appropriate rate of twist or an appropriately shaped form. The twist may be applied while maintaining a cast (plastic deformation) within the welding wire. The zero twist coil formed may be paid off or distributed in a no twist condition such that the coil 10 does not need to be rotated during pay off of the welding wire W. In the example shown, the coil is created using the REELEX ® winding process provided by REELEX ® Packaging Solutions, Inc. and its predecessor Windings International, which has been described in U.S. Pat. Nos. 5,678,778; 5,803,294; and 7,249,762, which are incorporated by reference. Certain improvements to these winding processes necessitated by applying them to a welding wire form part of the invention and are described in more detail below.

Figure 1:
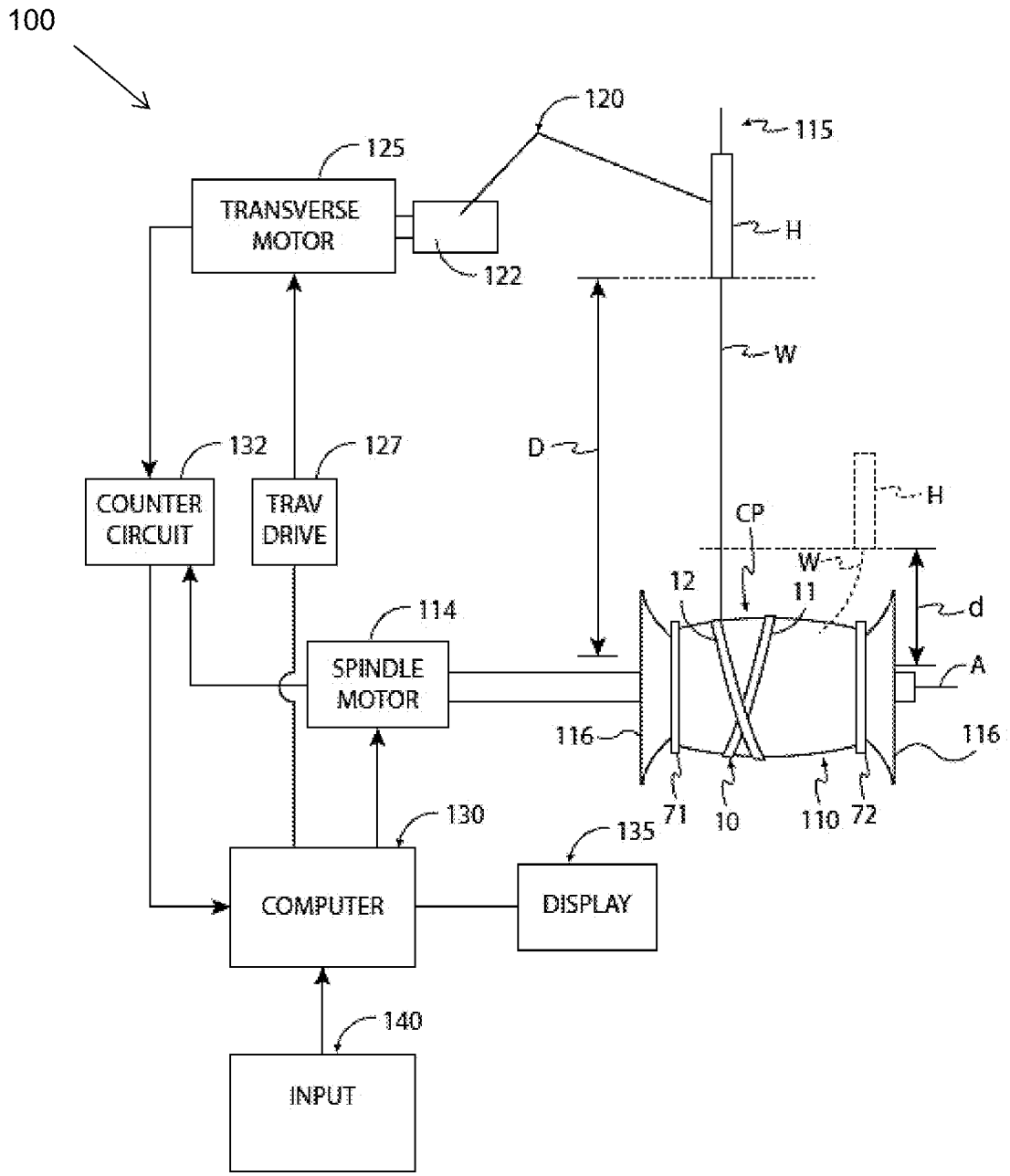
FIG. 1 is a partially schematic view of a system for packaging a welding wire coil according to the invention.

In particular, if the welding wire is bent sufficiently it will deform and impart a pitch to the wire. This pitch may interfere with payoff of the wire from the coil and cause improper feeding or tangling of the wire. It also may prevent good contact between the torch tip and the wire during the welding process. To that end, welding wire is more sensitive to lateral angles of the wire relative to the coil created by the coil forming head. A wire coiling system 100 is shown in FIG. 1.

The system 100 may include a mandrel 110 on which welding wire W is coiled. The mandrel 110 is supported on a rotating shaft that is driven by a spindle motor 114. A head H receives wire from a welding wire supply, generally indicated at 115. The head H moves transversely as the mandrel 110 rotates to lay coils of wire in the desired pattern to form a coil 10. For example, cooperative movement of the head H and mandrel 110 may be used to form at least a first turn 11 and a second turn 12 that respectively have a positive and negative angle relative to a plane extending radially outward from the mandrel's axis A. The first turn 11 and second turn 12 overlap each other at a cross-over point CP. In the example shown, the combined rotation of the mandrel 110 and transverse movement of head H cause the turns 11, 12 to form a figure eight pattern as the coil 10 is built up on the mandrel 110. As shown, lateral movement of the head H may be effected by any suitable transverse drive, generally indicated at 120, including but not limited to a linear actuator, a slide, cam actuated linkage, or crankshaft assembly 122, as shown. Transverse drive 120 may be driven by a transverse motor 125. Any suitable controller may be provided to coordinate the movement of the head H and mandrel 110 including but not limited to a programmable logic controller or PC controller. In the example shown, a computer 130 is provided and connected to the spindle motor 114 and transverse motor 125 via a transverse drive circuit 127. Feedback from the transverse motor 125 may be obtained by a counter circuit 132 and communicated to computer 130. A display 135 may be provided to communicate operational information to the user and to prompt the user for input for set up or operation of the system 100. To that end computer may also communicate with an input device 140, such as a keyboard, touch screen, numerical keypad, dials, sliders, switches, voice recognition system, and the like. The REELEX® process, incorporated by reference above, provides a suitable system similar to the one shown in FIG. 1.

In the original REELEX® process (dashed lines) the head H resides relatively close to the coil 10, and as it moves transversely, an angle is formed by the wire W as it lags behind the movement of the head. Because of the short distance between the head H and the coil 10, the wire extends from the head at a sharper angle and, therefore, is subjected to a significant side bend as it exits the head. This sharp bend may plastically deform the wire and create pitch in the wire. To reduce the likelihood of forming a pitch in the wire, according to the invention, the head H (solid line) is placed at a distance D that is greater than the distance d (dashed line) ordinarily used in the REELEX® process. In doing so, a less sharp angle is formed by the wire relative to the head H.

Figure 13:
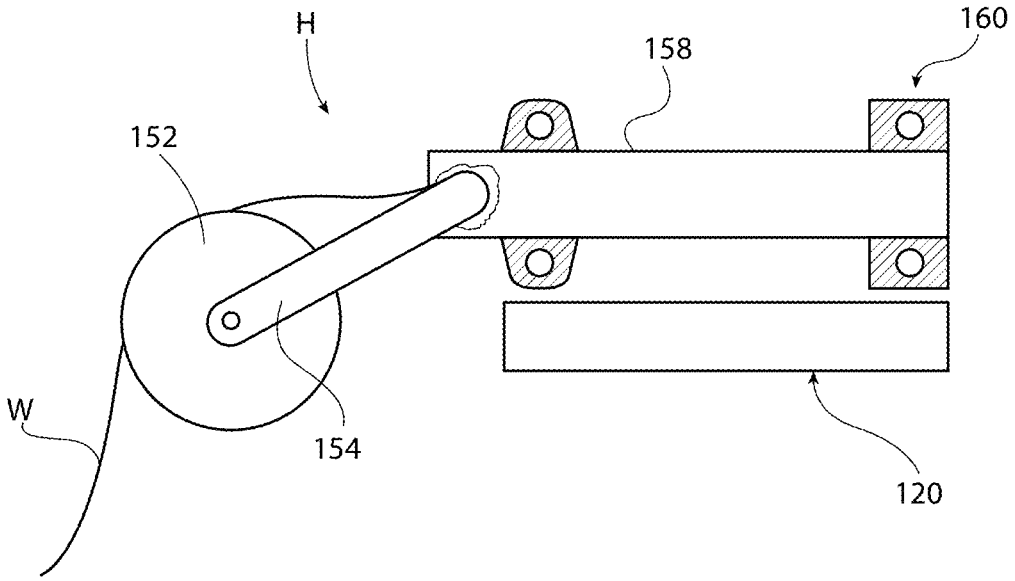
FIG. 13 is a schematic side elevational view of an alternative wire guide according to the invention.

According to another aspect of the invention, head H may be made rotatable to further facilitate winding of the coil 10. As shown in FIGS. 12 and 13, head H may include at least one wheel 152 rotatably supported between a pair of forks 154 that in turn are supported on the transverse drive 120. According to the invention, head H may be permitted to rotate as it is move laterally. To that end, a head H may include a body 158 that is rotatably supported within a journal or other bearing assembly 160, as shown. In this way, the head H may rotate within the bearing assembly as it is moved laterally. The effect is for the fork and wheel of the head to swing much like the front wheel of a bicycle. This change does not materially affect operation of the REELEX® process.

This process may proceed as described in the aforementioned patents to form successive coils of wire that intersect at cross over points that are spaced circumferentially along the mandrel 110 to build up the coil 10. As the coil is built up i.e. increases in diameter, the cross over point is advanced circumferentially to prevent the cross over points from overlapping doubling the overlapping material. By spacing the cross over points in this manner, the density of the wind is effectively increased. In this process, however, the lateral swing ($L_o$) of the transverse drive assembly is constant moving from one extreme of the mandrel to the other without lateral variation of the cross over points. The effect is for the cross over points to accumulate more toward the center of the coil forming a barrel shaped profile seen in FIG. 9.

Figure 2:
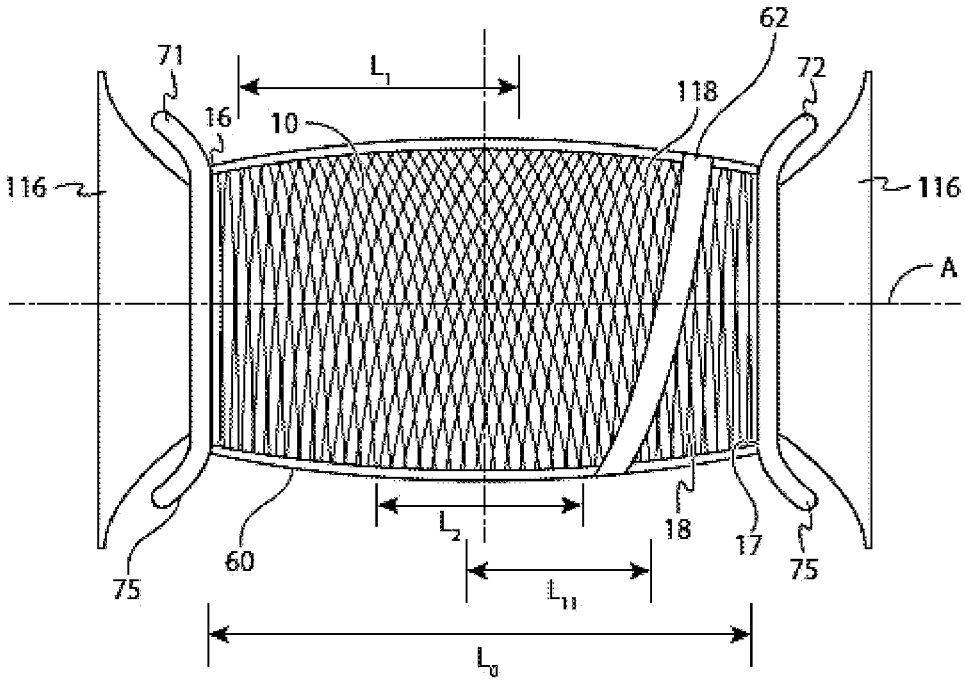
FIG. 2. is an enlarged view of a mandrel assembly used in forming a welding wire package according to the invention.

In accordance with another aspect of the invention, in addition to the circumferential spacing of the cross over points, lateral spacing of the cross over points CP may be made to adjust the distribution of the wire across the length of the mandrel 110. This improvement increases density without the aforementioned build up of material, which leads to a coil that is difficult to control. To that end, the transverse drive 120 may swing across less than the entire mandrel for a period of time. For example, as schematically shown in FIG. 2, lateral swings ($L_1$, $L_2$ . . . $L_N$) of less than the entire length of the mandrel 110 may be made to vary the cross over points in a lateral sense to further increase wind density or to provide a wire distribution that having a more even thickness across the length of the coil 10. It will be appreciated that lateral variation of the cross over point may be made without varying the end point of each turn i.e. each turn will continue to extend to the edges of mandrel 110. The lateral variation of cross over points CP is obtained by changing the loop length of the respective turns on either side of the cross over. For example, varying the dwell time between respective turns on opposite sides of the cross over point.

Figure 8:
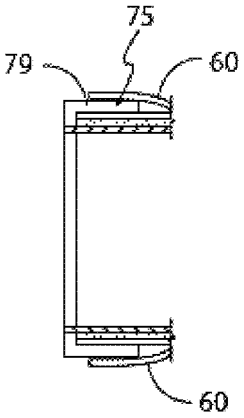
FIG. 8 is a view similar to FIG. 6 showing the end form fully integrated in the wire package.

The FIG. 8 winding of the wire develops an opening or gap 25 opposite the cross over points CP. The gap 25 may be used for pay off of the wire, as discussed more below. The size of the gap 25 may be controlled by the relationship between the lateral motion of the head H relative to the rotation of mandrel 110. In the example shown, gap 25 is formed in a sector that represents about 90 degrees of the circumference of the coil 10. This gap 25 is formed by the head H changing from an advancement of the cross over to a retarding of the cross over point after about 270 degrees of rotation as described in detail in the REELEX ® patents incorporated above. Smaller or larger gaps may be formed by varying the advancement and retarding point. In one example a 20 degree opening was formed by rotating 340 degrees before the head H reversed its motion.

To provide additional stability in gap 25, a separator 30 may be provided. The separator 30 may have any form and generally covers the gap 25. Separator 30 may be used to provide a non-adhesive edge when incorporated within sheath 60 as discussed below. As shown, separator 30 may mimic the shape of the gap 25 in the coil. For example, for a 90 degree gap 25 (shown) the gap shape is a parallelogram or diamond shape formed by the angular extension of the turns adjacent to gap 25. It will be understood that other shaped gaps may be formed through variation of the winding pattern.

Separator 30 does not have to mimic the shape of the opening and may include any shape including other polygons, circular shapes, or unique shapes that add ornamentation or a decorative element to the package. The separator 30 may simply lie on top of the coil or include an insert, generally indicated at 35, that extends into the gap 25 or further into the hollow core 27 of the coil 10. In the example shown, separator 30 includes a diamond shaped plate 32 that lies on the outer surface of coil 10 and generally covers gap 25. Plate 32 defines a central opening 34 for payoff of the wire and includes a hollow insert 35 that attaches to plate 32 and extends into core 27 of coil 10 through gap 25. Plate 32 may include an adaptor 36 to facilitate attachment of insert 35 to plate 32 or the plate and insert may be integrally formed. The shape of the opening 34 in plate 32 may vary from the circular shape shown and include polygonal shapes, ellipses, and other irregular shapes. The shape of insert 35 may vary with the opening 34 when the insert 35 conforms to the opening or the adapter may be used to transition between the opening and the insert shape. While the insert 35 is shown extending into the core 27 of coil 10, insert 35 may be attached to extend outward from separator 30 or an insert 35 may extend inward and outward of separator. Outward extension of the insert 35 may be used to attach adapters used in delivering wire to the welding process.

In addition, insert 35 may have a variety of lengths and generally is any surface that extends inward from separator 30. For example, insert 35 may include one or more protrusions that extend inward to engage the wire at the sides of gap 25 to help maintain the position of these wires or to locate the plate 32 relative to gap 25. Or, longer protrusions may be used to extend into the core 27 of coil 10. Insert 35 may define a passage 38 to facilitate payoff of wire W from the interior surface of coil. In the example shown, insert 35 includes a circular tube that extends inward from plate 32 into core 27. The shape of insert 35 may vary across its length. For example, the insert may flare outward as it extends radially outward from the core to transition from a smaller opening within the core 27 to a larger opening 34 in the separator 30. Other variations in the wall 39 of the insert 35 may be used to help guide or restrain the wire W as it is paid off from the inner surface of the coil 10.

With reference to FIG. 2, mandrel 110 may include end plates 116 that form a stop for the end turns of the wire W. These end plates 116 extend radially and axially outward from the ends of a barrel 118 of mandrel 110 to provide a clearance for movement lateral movement of the wire created by transverse drive 120. In accordance with the invention, a welding wire package, generally indicated by the number 50 is formed to hold the wire within the coil 10 against unintended movement that would distort the coil or cause the wire in the coil to payoff improperly or in a condition that could lead to a tangle or other disruption in a welding process. Package 50 reduces the likelihood that turns within the coil 10 will move unintentionally as the coil is removed from the mandrel 110 or during subsequent transport and handling. Welding wire package 50 may include a sheath 60 and end forms 70, as described more completely below.

Sheath 60 includes a material that covers at least the outer surface 14 of the coil 10. In one embodiment, the sheath 60 extends to cover first end 16 and second end 17 of coil 10. Sheath 60 is applied after the coil 10 is formed and may be applied while the coil 10 is still on mandrel 110. In the example shown, the end plates of mandrel 110 prevent wrapping of sheath material around the ends 16,17. It will be appreciated that end plates may be removed if wrapping of the sheath 60 around the ends 16,17 is desired. In such an embodiment, the sheath 60 forms the entire package 50 to restrain the ends 16,17 and body of coil 10. In the example shown, package includes end forms, generally indicated at 70, to restrain the turns of wire at ends 16,17, and thus, sheath 60 may be applied only to the body 18 of coil 10.

Sheath 60 restrains wire W to prevent axial expansion of coil to maintain the coil shape and prevent wire turns from moving within the body 18 of coil. In doing so, the wire becomes an integral part of the package and forms a structural component thereof. Further, to ensure no contamination of the weld wire, if required, additional wire can be included after the coil is tied off to provide a disposable package element.

The spring forces within the wire created by forming the turns may create a tendency for the body of the coil 10 to expand or shift with the individual turns then sliding amongst each other. By the same token a sheath that would distort the coil or promote movement of the turns would be counterproductive. Therefore, suitable sheath materials include a structure that may be applied to cover the wire coil without applying compressive forces that would deform or cause the wire within the coil to move or cloying forces that would prevent turns from properly releasing from the coil 10. To that end, materials that are dimensionally stable, flexible, and applied without significant shrinking or stretching of the material are useful including but not limited to polymer films, pulp materials such as paper tape, textile materials, fiber reinforced tapes, and the like. Heat shrink films may be used provided that they do not contain residual tension. In the example shown, a cellophane material was used. An adhesive layer may be provided to attach the sheath 60 to coil 10. In the example shown, the cellophane material was a packing tape that included an adhesive on its inner surface.

Figure 9:
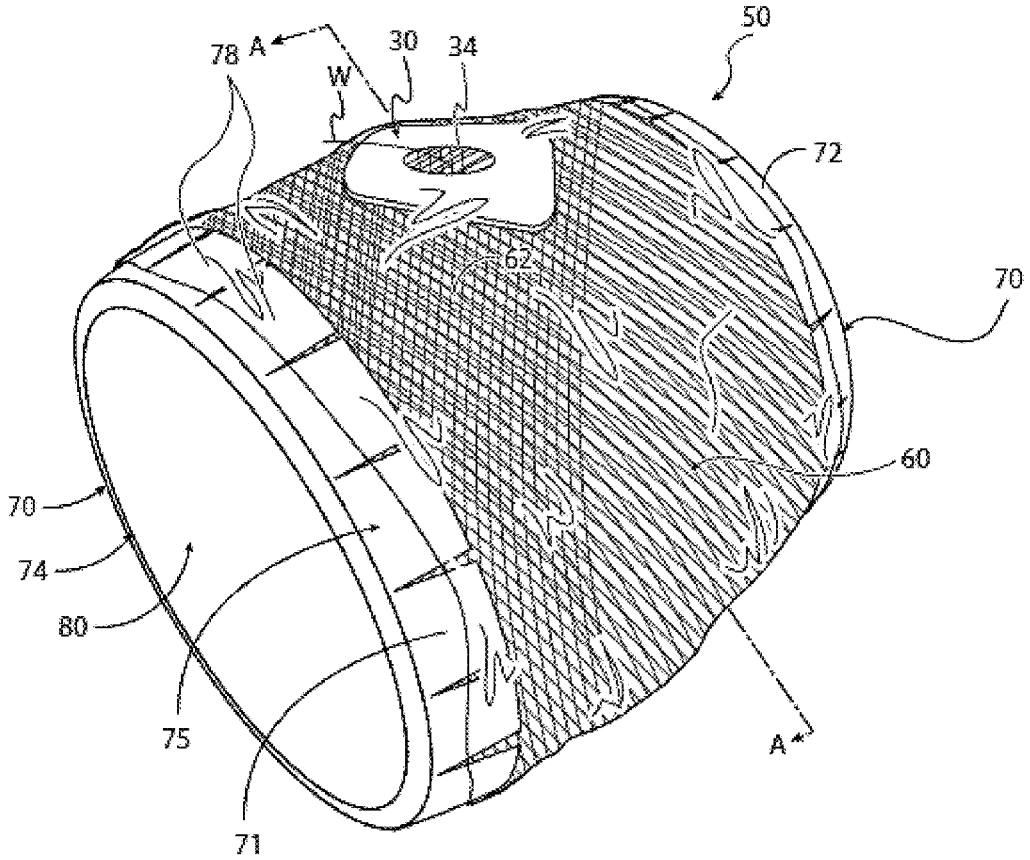
FIG. 9 is a perspective view of a welding wire package according to one embodiment of the invention.
Figure 9A:
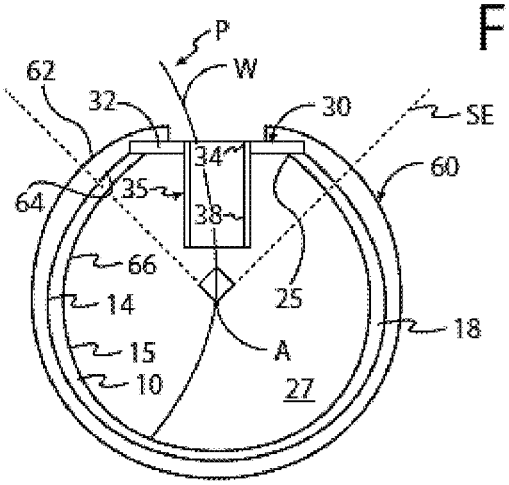
FIG. 9A is a partially schematic sectional view as might be seen along A-A in FIG. 9.
Figure 9B:
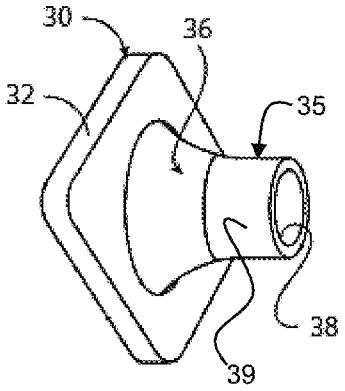
FIG. 9B is an enlarged perspective view of a separator according to the invention.

Sheath 60 may include a single layer of material that encapsulates at least the outer surface 14 of coil 10 or sheath 60 may be built up by a strip of material that has a lateral dimension smaller than the axial dimension of the coil 10. For example, sheath 60 may be formed from cellophane packing tape 62 that is wound about the coil 10. Sheath 60 may be wound about coil 10 in any pattern with sufficient overlap to prevent shear failure. Suitable patterns include but are not limited to parallel circumferential windings, successive axially extending strips, criss-crossing patterns, or spiral patterns. In the example shown, a spiral winding pattern is used. In testing of cellophane packing tape, strips of material having a lateral dimension between 1 inch and 3 inches were found suitable. The particular example shown includes 2 inch wide packing tape where the successive turns of tape are overlapped by approximately one inch. One or more layers of tape may be applied to form the sheath 60 and wound in any known manner. The depicted example includes tape 62 wound in a spiral form. The spiral wind of tape 62 is made with two layers resulting in four layers of tape 62 covering outer surface 14 of coil 10. The hand of the wind or each layer may match or be of opposite hand without affecting the operation of the package. In this example, winding of the tape 62 occurs while the coil 10 is still on the winding mandrel to ensure that the welding wire is not permitted to move or slip before the sheath 60 is attached. The adhesive 64 (FIG. 9A) on the interior 66 of cellophane tape 62 adheres the tape 62 to the outer surface 14 of the coil 10. As shown in FIG. 9A, the separator 30 may be located on the coil 10 before the sheath is applied such that the sheath 60 wraps around the separator 30 to hold it in place on the coil 10. It will be appreciated that the opening 34 of the separator may not be wrapped, or the winding pattern may leave an opening corresponding to the gap 25 in coil 10, or the sheath material may be cut away to allow the wire W to be paid out from the opening, as shown.

According to another aspect of the invention, end forms 70 are provided on mandrel 110 to axially restrain coil 10 by integrating the forms 70 with sheath 60 to form package 50. End forms 70 are used to further prevent axial extension of the coil 10 once it is removed from the mandrel 110. To resist the axial spring force of wire within coil 10, end forms 70 may be rigid at the edge of coil 10 and generally includes an edge portion 73 that is coextensive with the edge or end of coil 10 to act as a stop. As discussed below, portion of end form 70 may be formed from a flexible material or made flexible according to other aspects of the invention.

A first end form 71 may be placed adjacent to a first end 16 of the coil 10 and abut the end of the coil 10 while it is on the mandrel 110. Likewise, a second end form 72 may be placed adjacent to the second end 17 of the coil 10 and abut the second end 17 of coil 10 while it is mounted on the mandrel 110. To accommodate the mandrel 110, end forms 70 may define a central opening 74 through which the mandrel 110 passes as best shown in FIGS. 3-5 and 6-8 (e.g., mandrel receiving opening). For example, the edge portion 73 may define the mandrel receiving opening.

The end forms 70 may include an extended element 75 that extends radially outward of and axially away from the edge portion 73 and, thus, outward of the outer surface 14 of the coil 10. This element 75 may be inherently flexible or made flexible to bend the element outward or inward of central portion 73, as needed. In the examples shown in FIGS. 3-8, element 75 is made to flex inward toward coil 10 to wrap extended element over at least a portion of coil 10 to encapsulate the ends 16, 17 of coil 10 and facilitate integration of end forms 70 with sheath 60. Element 75 may be made flexible by choosing a flexible material, selecting a thickness of the element 75 that facilitates bending, or providing a crimp or score line 76 to facilitate bending.

Figure 3:
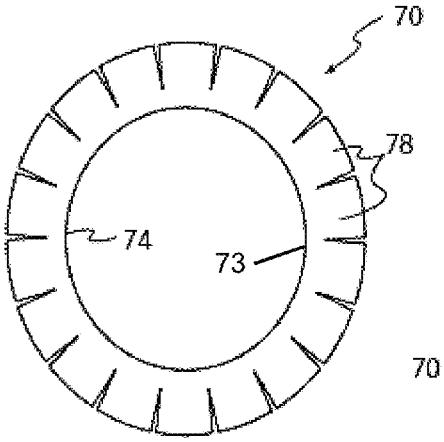
FIG. 3 is a end elevation view of an end form according to one embodiment of the invention.
Figure 4:
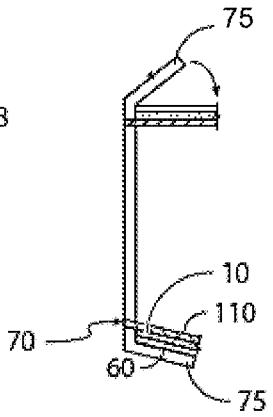
FIG. 4 is a partially fragmented partially sectioned side view shown the end form of FIG. 3 being integrated into a wire package according to the invention.
Figure 5:
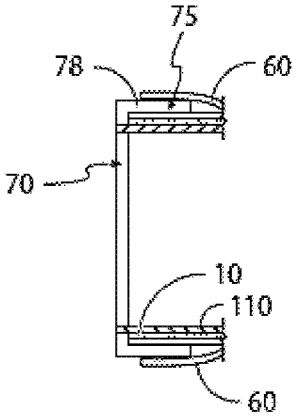
FIG. 5 is a view similar to FIG. 3 showing the end form fully integrated in the wire package.

As shown, in FIGS. 3-5, extended element 75 may form a constant surface or be broken into individual elements as discussed with reference to FIGS. 6-8 below. The extended element 75 may be generally planar in shape or assume other shapes or profiles as required by the mandrel shape and winding of the coil. For example, with reference to FIG. 2, extended element 75 may be formed to extend outward relative to edge portion 73 to provide a clearance for wire W. The end form is provided to form an inextensible packaging that contains the windings against axial lengthening of the coil in an accordion-like manner upon release of the tooling. The unitary extended element 75, shown, extends radially outward beyond the outer surface 14 of the coil 10. This element 75 may be incorporated into sheath 60 by bending it inward to overly a portion of coil 10 and applying a portion of sheath 60 over the bent element 75, or sheath 60 may extend axially outward of coil 10 to overlie a portion of an extended element that extends outward of the coil 10 (FIG. 2).

Figure 17:
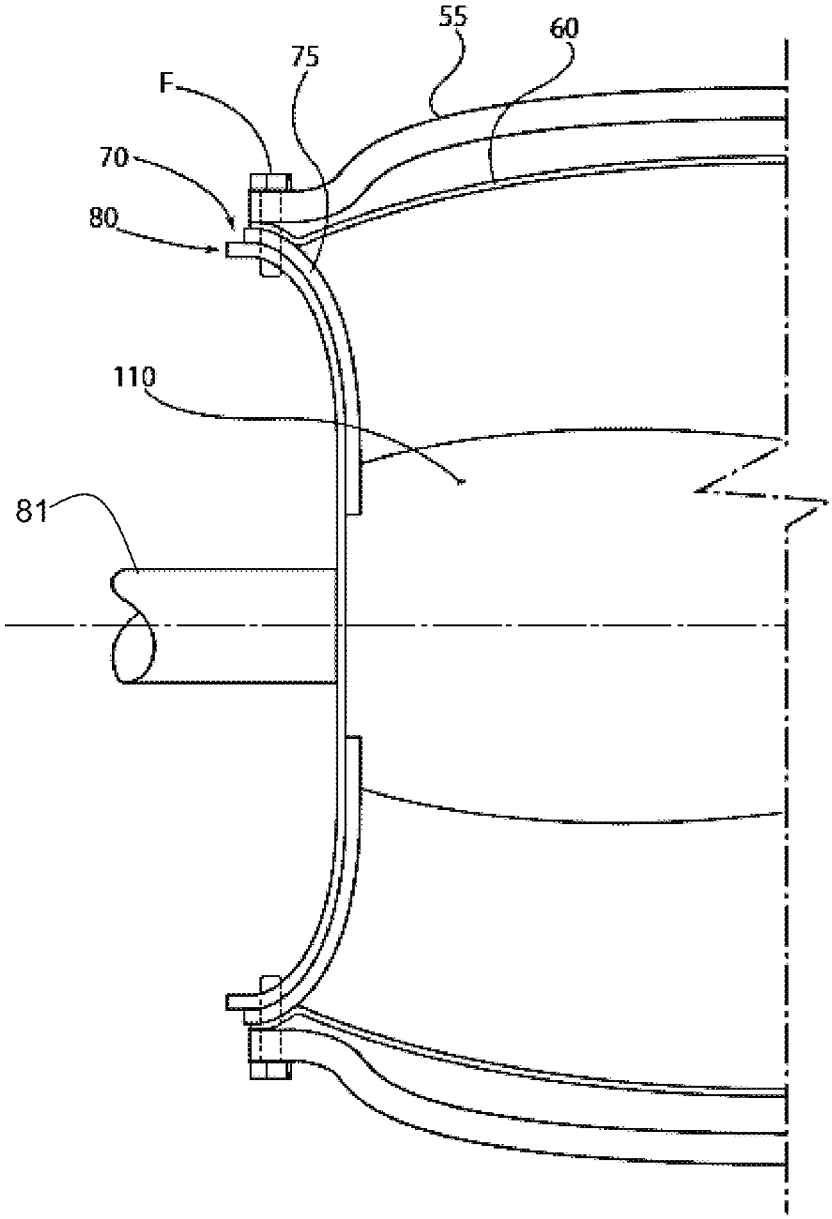
FIG. 17 is a sectioned side elevational view of a welding wire package showing an alternative end form according to the invention.
Figure 18:
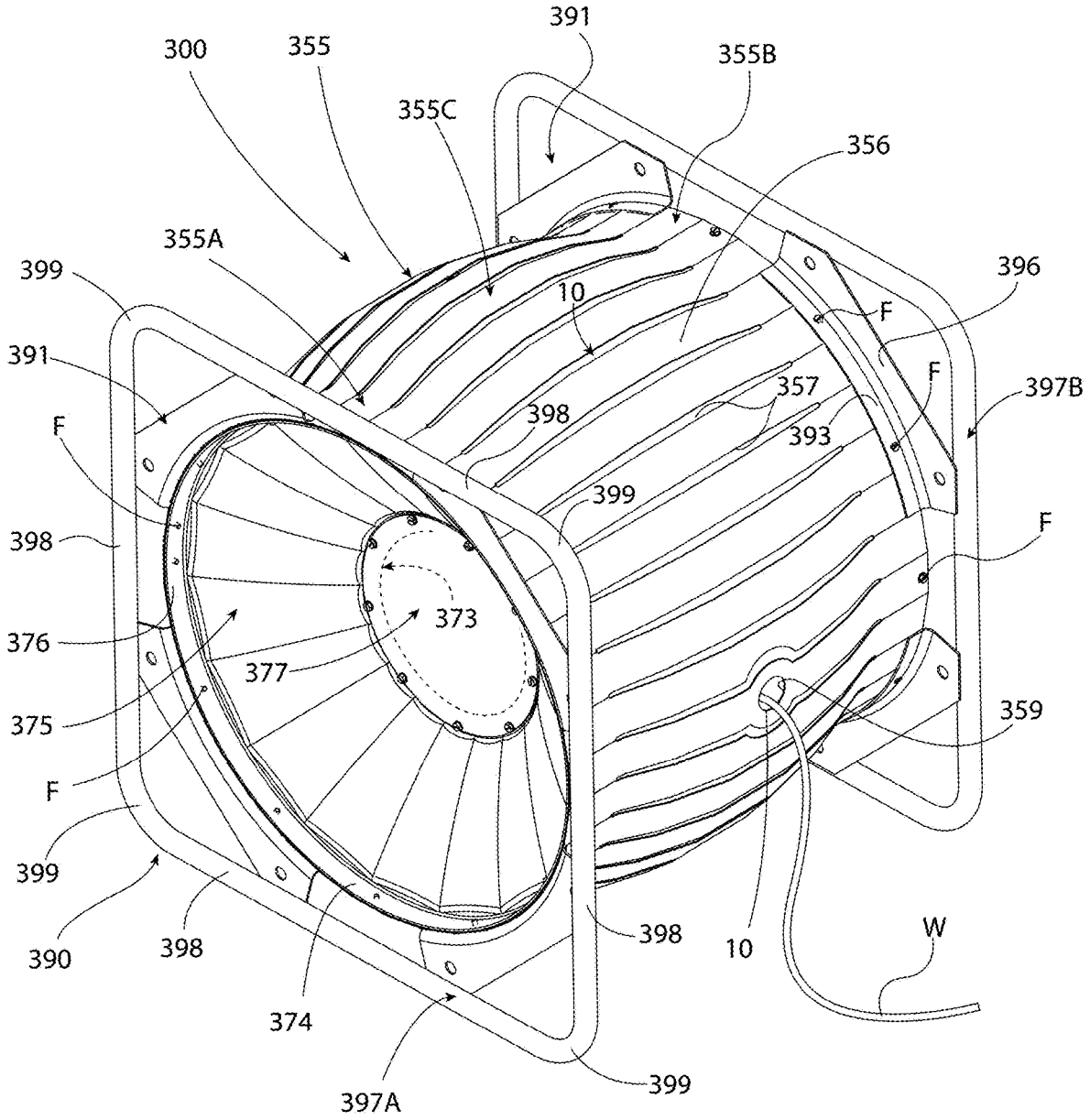
FIG. 18 is a top perspective view of a welding wire package according to another embodiment of the invention.
Figure 19:
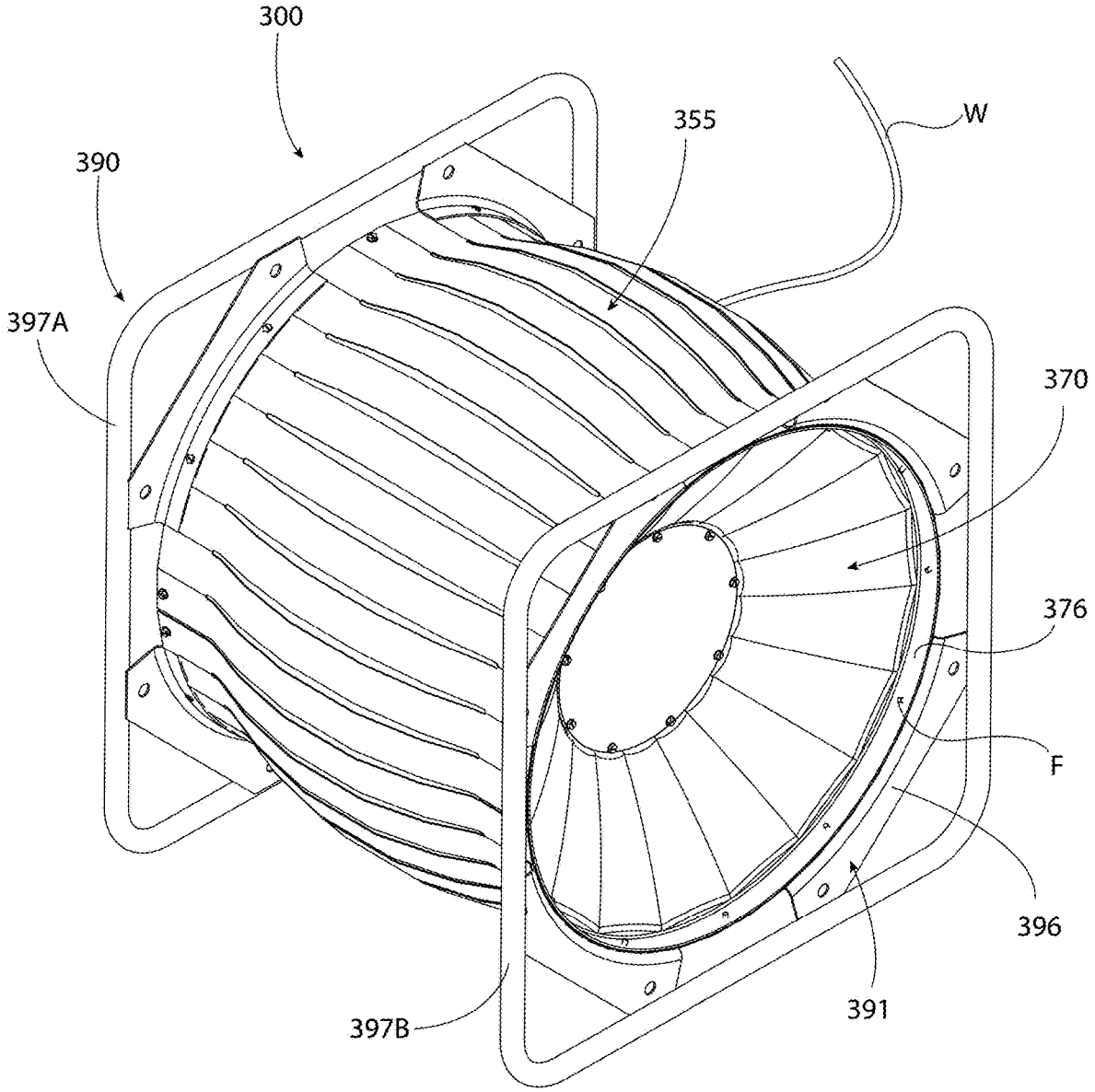
FIG. 19 is a bottom perspective view thereof.
Figure 20:
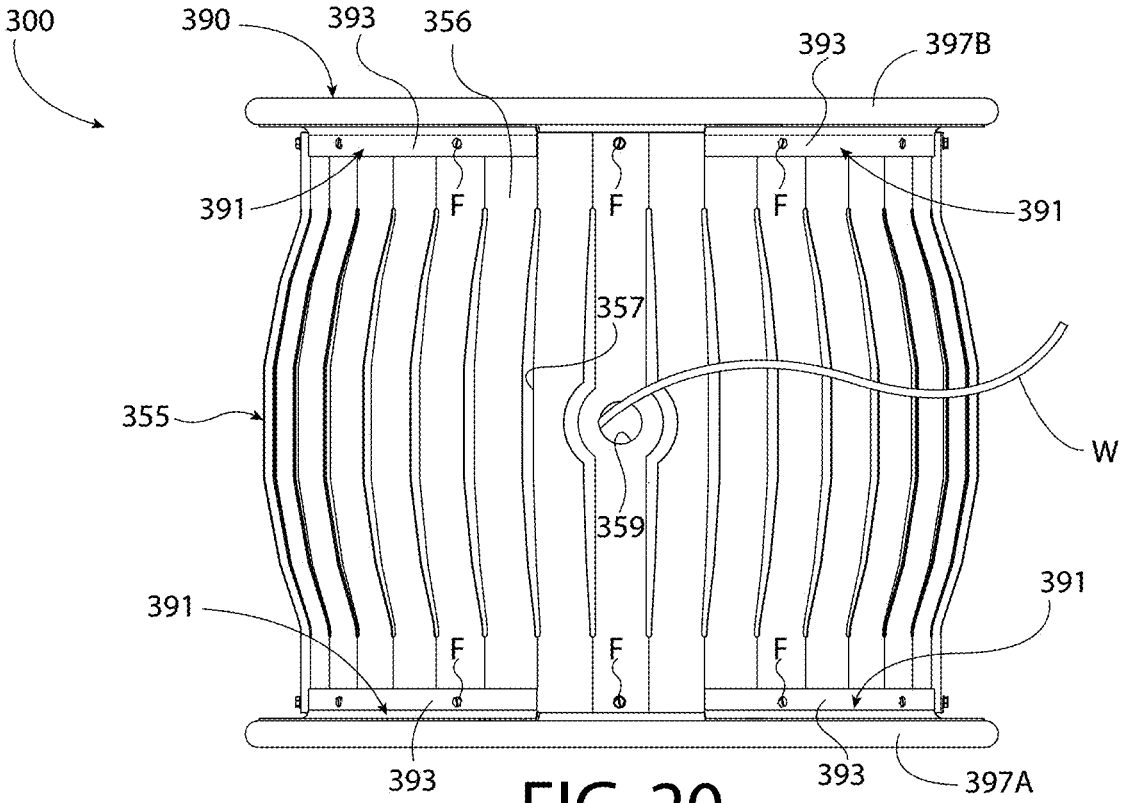
FIG. 20 is a front view thereof.
Figure 21:
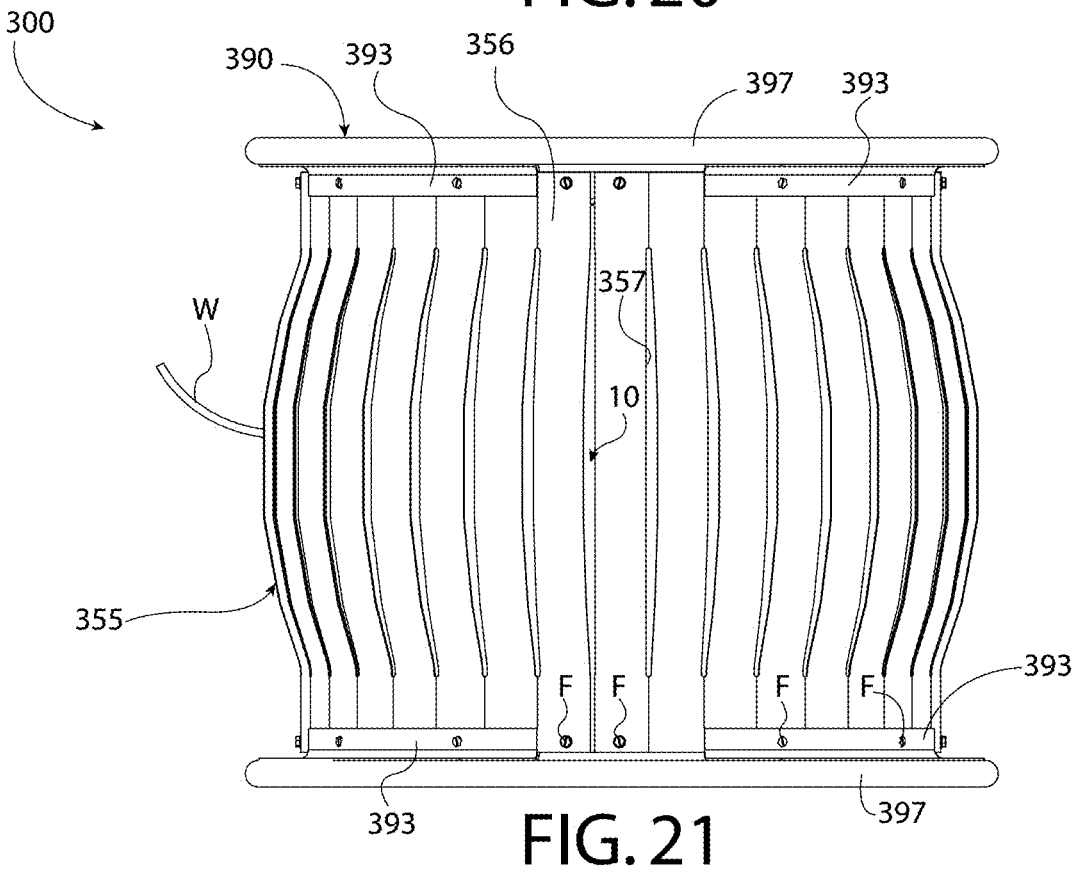
FIG. 21 is a rear view thereof.
Figure 22:
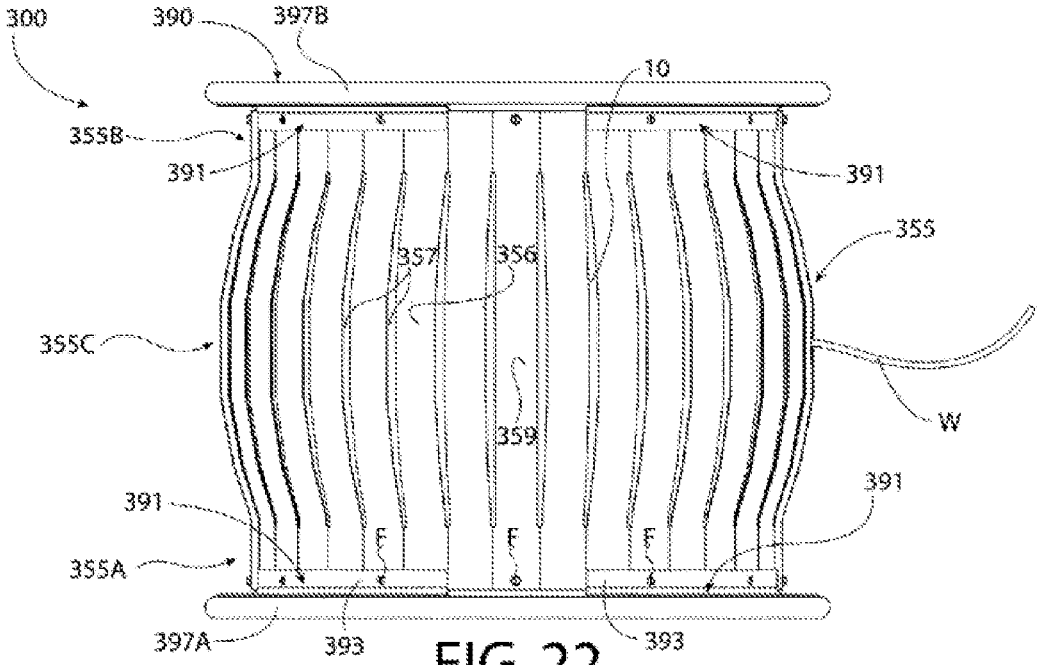
FIG. 22 is a top view thereof.
Figure 23:
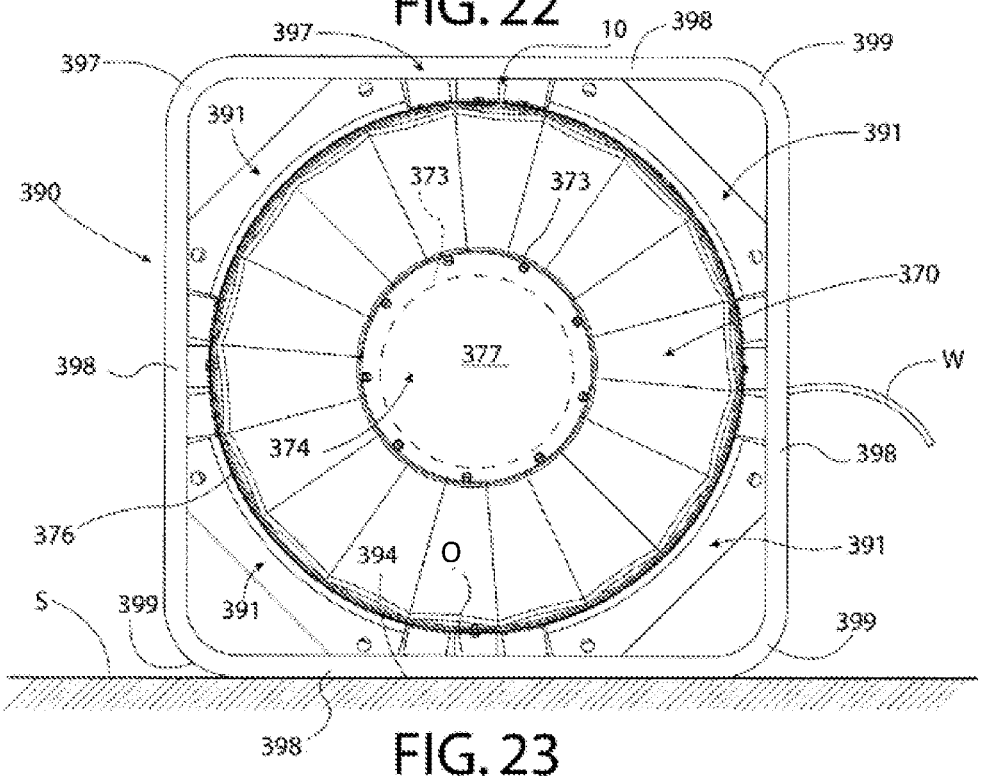
FIG. 23 is a left view thereof.

In FIG. 17, an example is shown where extended element 75 is formed or bent such that it extends outward and downward from coil 10 to overlie edge portion 73. In this configuration, extended element 75 may be used to provide a mounting surface for additional package elements, fasteners, external supports or wire pay off equipment, generally referred to as an attachment, indicated by the number 55. The attachment 55 and method of fastening it to extended element 75, shown, are not limiting.

With reference to FIGS. 18-23, a welding wire package 300 according to another embodiment of the invention is shown. As shown in this embodiment, attachment 55 may include a coil cover or shell, generally indicated by the number 355. Shell 355 may include one or more shell members 356 that attach one or both of the end forms 370. In the example shown, shell member 356 includes a generally cylindrical cover that overlies the coil 10 and sheath 60. Shell 355 may have any shape that overlies the coil 10. In the example shown, shell 355 is somewhat barrel shaped having a center section 355C that bulges radially outward relative to first end section 355A and second end section 355B. As shown, one or more slots 357 of other opening may be formed in shell 355 to facilitate its formation or to provide flexibility when wrapping the sheath 60 around coil 10. As discussed previously, the overlapping of the loops of the coil 10 has the effect of the coil 10 being thicker toward the center of the coil 10. The bulge created by the increased thickness may be accommodated by the flexibility of the material selected, the shell 355 may be preformed with a shape that accommodates the increased thickness, or shell 355 may be made so that it expands to accommodate the increased thickness when it overlies the coil 10. In the example shown, plural lengthwise slots 357 are provided about the circumference of shell 355 to divide center section 355C of shell 355 to give the appearance of plural slat like shell members 356 spanning the center section 355C of shell 355. The slots 357 allow the shell 355 to flex and conform to the shape of coil 10. As shown, the end sections 355A and 355B may have a generally cylindrical shape to conform to the ends of coil 10. Since the material thickness is relatively uniform at this area of coil 10, the end sections 355A,355B may not be slotted as in the center section 355C.

Shell 355 may define a payout opening 359 that overlies the gap 25 in coil 10 through which the wire W is paid out of coil 10. In the example shown, payout opening is formed in the center of center section 355C of shell 355 one side. Opening 359 may have any shape including but not limited to the circular shape shown. Shell 355 may attach to end forms 370 at end sections 355A,355B as with suitable fasteners including but not limited to mechanical fasteners including rivets, screws, bolts, staples, clips; a weld; or an adhesive. Shell 355 may be constructed of any material including but not limited to metals, plastics, or pulp materials including wood or cardboard. In the example shown, shell 355 and end forms 370 are constructed of metal, such as steel, stainless steel, or aluminum. The selection of material may vary depending on the weight of the coil or the expected working environment. In the example shown, coil 10 is expected to weigh in excess of 2000 lbs.

According to another aspect of the invention, end form 370 is attached to a support frame, generally indicated by the number 390 to facilitate transport and handling of the coil 10. The end form 370 shown is not limiting as other end form configurations may be used as discussed in previous embodiments. End forms 370 may have other geometric shapes including regular and irregular polygons including but not limited to triangles, squares, hexagons, octagons, rectangles, and the like. Arbitrary or irregular shapes may also be used.

In the example shown, end form 370 includes an edge portion 373 defines a central opening 374 that receives the mandrel 110 therethrough. Edge portion 373 abuts the edge of coil 10 after it is formed. An extended element 375 may extend outward from edge portion 373 and also may abut the edge of coil 10 when coil 10 has a thickness greater than edge portion 373. In the example shown, extended element extends radially outward and axially outward from a circular edge portion 373 to form a frusto-conical end form 370. The frusto conical shape of end form 370 allows stacking and nesting of end forms 370 during storage before and after their use. It will be understood that other stackable and nesting shapes may be used to the same effect.

An annular flange 376 is formed at the outer extremity of end form 370. Support frame 390 may attach directly to end form 370 or support brackets, generally indicated at 391 may be provided. In the example shown, brackets 391 include a coil flange 393 that conforms to the curved surface of flange 376 formed on end form to facilitate attachment of the bracket 391 to end form 370. It will be understood that other flange shapes may be used depending on the configuration of the end form 370. Flange 393 may be attached to flange 376 with a suitable fastener F including but not limited to mechanical fasteners including rivets, screws, bolts, staples, clips; a weld; or an adhesive. Removable fasteners may be used to facilitate removal of the brackets 391. Shell 355 may also attach to end forms 370 at flange 376 with similar fasteners F. In the example shown, the fasteners used to attach the bracket 391 and shell 355 to end form 370 are screws. According to another aspect of the invention, once the end form 370 is released from mandrel 110, opening 374 may be capped with a center plate 377. Center plate 377 may have any shape or form and may add rigidity to end form 370. To that end, center plate 377 may include shapes that do not completely close the opening 374. Optionally, as shown, center plate 377 may conform to opening 374 to close the opening 374 to prevent debris or other material from entering the interior of coil 10. Center plate 377 may be constructed of any material suitable for either adding rigidity, closing the opening or a material that accomplishes both. To allow the user to view the interior, a lexan or transparent center plate 377 may be used as shown. Center plate also may be attached to end form 370 with fasteners F as discussed above.

Support frame 390 may have any shape or configuration and include stand like members. In general, support frame 390 is has a portion that extends outward of the perimeter of the coil 10 to contact a supporting surface S and elevate the coil 10 above the support surface. Optionally, as shown, support frame 390 may have perimeter 394 that extends outward of the perimeter O of coil 10 to provide further protection by spacing the coil 10 from adjacent objects. According to another aspect of the invention, support frame 390 includes first and second frame member 397A and 397B placed at either end of coil 10 and attached to package 300. It will be understood that the frame members 397A, 397B can be at other locations relative the coil including locations inboard or outboard of the position shown.

As discussed previously, support frame 390 may directly attach to shell 355 or end forms 370 or an intervening bracket 391 may be used. One or more brackets 391 may be used. In the example shown, four brackets 391 are provided and are spaced approximately 90 degrees from each other. The brackets 391 extend from one side frame section 398 to an adjacent side frame section 398 and span a corner or joint section 399 in the four sided support frame 390 shown. It will be understood that when additional sides are added to support frame 390 additional brackets 391 may be used as well. In the same configuration fewer brackets may be used by providing a bracket that spans a greater area and, therefore, the depicted example is not limiting.

Brackets 391 are used to attach support frame 390 to at least one of the shell 355 and end forms 370. The brackets 391 include support flanges 396 that extend radially outward from coil flange 393 and are fastened to support frame 390. Support frame 390 includes one or more frame members that form the frame profile. The frame profile may have any shape including but not limited to a circular shape or non-circular shape. A circular shape may facilitate rolling of the support frame 390. A non-circular shape may alternatively be used to provide defined positions for the coil 10. In the example shown, a frame members define a rectangular polygon that defines four positions for orienting the coil 10. In the example shown, the coil 10 is oriented such that the pay out position (indicated at opening 359) is located on a right hand side. It will be appreciated that rotating the coil 10 on support frame 390 will allow the payout position to be moved to a top, left and bottom position as well. Other polygonal shapes may be used to provide fewer positions (triangle) or additional positions by adding sides to the polygon including but not limited to hexagon, or octagon shapes. Frame members may be constructed of any material suitable for supporting the coil 10 and have any configuration including but not limited to solid forms or tubular forms. In the example shown, support frame 390 is assembled from tubular frame members constructed of steel. To form the frame profile, frame members include side frame sections 398 joined to each other by four joint sections 399. In the rectangular example shown, there are four side frame sections 398 and four joint sections 399. The joint sections 399 form a 90 degree bend to connect adjacent side frame sections 398. It will be understood that the angle of the joint section 399 will change when other polygonal shapes are used.

Figure 6:
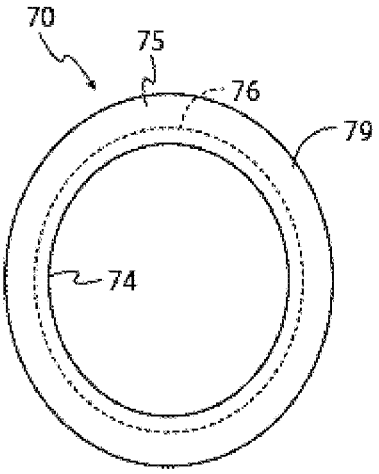
FIG. 6 is a end elevation view of an end form according to one embodiment of the invention.
Figure 7:
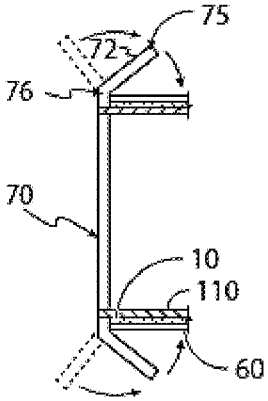
FIG. 7 is a partially fragmented partially sectioned side view shown the end form of FIG. 6 being integrated into a wire package according to the invention.

As shown in FIGS. 6-8, extended element may include plural tabs 78 radiating outward beyond the outer surface of coil 10. These tabs 78 are flexible and may be bent inward to lie over a portion of the outer surface of the coil 10. In the example shown, after a layer of sheath material is applied to the outer surface 14 of the coil, the tabs are bent inward to over lie a portion of coil 10 and then additional sheath material is applied over the tabs to hold them in the bent position. In the example shown, the adhesive tape used to form the sheath attaches the tabs to the underlying first layer of sheath material. It will be appreciated that other structures may be used to capture the edge of the coil 10.

In accordance with another aspect of the invention, a hub generally indicated by the number 80 may be provided to fill the opening 74 defined by end form 70 (e.g., hubs 80 can be configured to be attached to at least the first end form 71 or the second end form 72). As shown in FIG. 9, hub 80 may include a planar member 82 that acts as a plug to fill the opening 74 on either side of the coil 10. Planar member 82 may be made of any material including but not limited to paper, cardboard, polymer, rubber, foam, wood, or metal. The planar member 82 may be flexible or rigid. In the example shown, planar member 82 is made from cardboard and acts only as a cover to keep contaminates out. In other embodiments, a clear plastic material is used to allow the user to observe payout of the wire W from the inside surface of the coil 10. In still other embodiments, hub 80 may be a structural member on which the package 50 is supported. To that end, hub 80 may be adapted to support the package 50 in a stationary fashion or, as shown, hub 80 may be adapted to rotatably support package 50. Hub 80 may incorporate an opening through which a solid shaft or pair of stub shafts are received to allow the package to rotate via one or more of the hubs 80. Alternatively, hub 80 may extend around the outer surface of the coil to provide support for the trunnion or other external pay off equipment.

Figure 14:
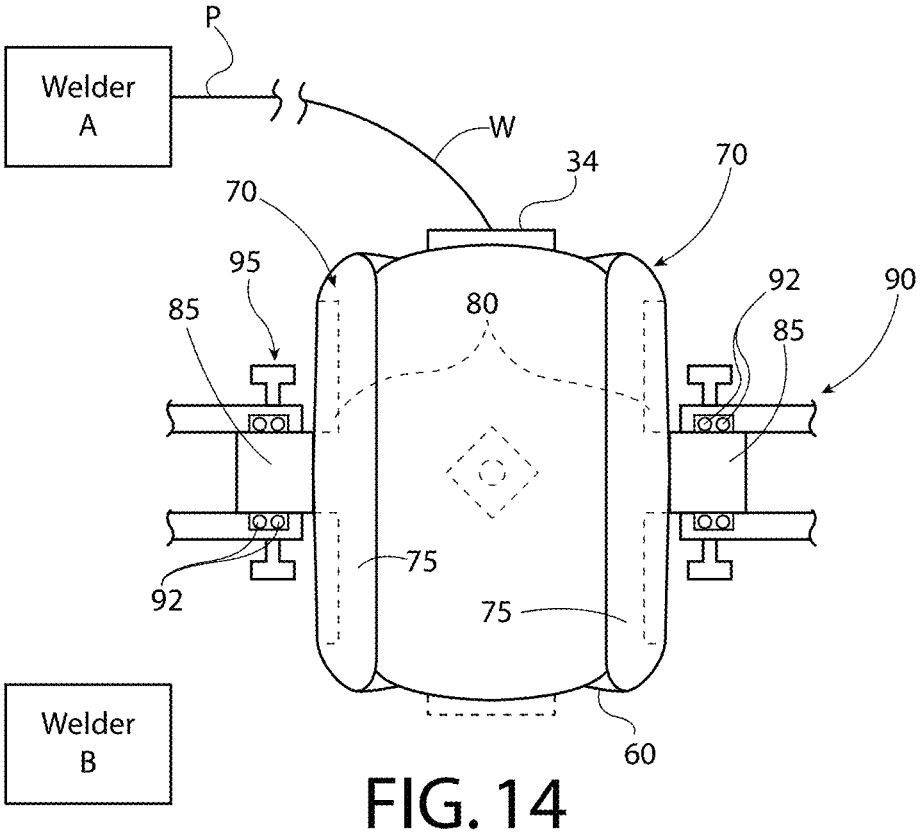
FIG. 14 is a schematic side view of a welding wire packaged mounted on a trunnion to allow rotation of the welding wire package.

Alternatively, as shown in FIG. 14, hub 80 may include a projection, like a trunnion 85 that extends axially outward from hub 80 to mount the welding wire package 50 on a support, generally indicated at 90. Support may form part of the package, such as, a crate, or box, or be a separate element, such as a frame or stand used to support the coil upon delivery. In the example shown, support 90 includes trunnion bearings 92 that rotatably support trunnions 85 extending from each hub 80 within end form 70. This configuration allows the welding wire package 50 to be rotated relative to the support 90. A locking assembly, generally indicated at 95, may be used to fix the rotational position of the welding wire package 50 in a selected position. Locking assembly 95 may be any assembly or individual member that can be used to fix the rotational position of the welding wire package 50 including but not limited to a brake assembly, a set screw, a locking pin, a clamp and the like. As shown, welding wire package 50 may be rotated to position the opening 34 in a variety of rotational positions to facilitate feeding of the wire from the coil 10 to a welder. The rotational position selected by the user may depend on the location of the welder i.e. off to one side, or the type of feeding arrangement, such as a top position when wire is fed from the top or a bottom position when wire is fed from the bottom. In the example shown, plural predefined positions, such as a first side and second side position may be beneficial when switching the wire between two welders (welder A and welder B) on either side of the package, as shown.

With reference to FIGS. 9A and 14, welding wire coil includes a free end or payoff end P of coil 10 that is adapted to be fed into a welder. Payoff end P extends outwardly from an interior surface 15 of coil 10 and exits at gap 25 defined in coil 10. When a separator 30 is used, payoff end may exit coil 10 through an opening 34 defined in separator 30.

According to another aspect of the invention, a method for forming a welding wire package 50 includes providing a mandrel 110 having a first end form 71 at one end and a second end form 72 at a second end of the mandrel 110, as shown in FIG. 1. The end forms 70 include a extended element that extends radially outward of the outer surface 14 of coil 10 as discussed above. In one embodiment, the extended element is a plurality of tabs (FIGS. 3-5) that extend about the circumference of the end form 70. In one embodiment of the method, the tabs are held in an upright configuration where they lie in a plane formed by the respective end of the mandrel or in a position axially outward of this plane to avoid interference with the winding operation. Welding wire W is wound on the mandrel barrel 118 located between the end forms 70 to form a coil 10. The coil 10 may be formed by winding the welding wire in successive FIG. 8 patterns to define a coil with plural cross over points CP. According to the invention, when a coil 10 is formed using the FIG. 8 pattern, the turns of wire W may form an gap 25 in the coil on at least one sector SE of the coil 10. With the coil 10 formed and still mounted on the mandrel 110, a sheath 60 is applied to the outer surface 14 of the coil 10. In the example provided, the sheath 60 is formed by spiral wrapping the outer surface 14 of the coil 10 with a cellophane tape 62, including but not limited to packing tape. Then, the extended element of each end form 70 may be bent inwardly to overlay a portion of the coil outer surface 14. If the extended element has been restrained, the restraint would be removed first to allow the element 75 to be bent inward(FIGS. 4-5 and 7-8). In the example shown in FIGS. 3-5, tabs 78 on the end form 70 are folded down to overlie the coil at each end. With the tabs 78 folded, a second layer of tape is spiral wrapped over the coil and the folded tabs 78 to fully integrate the tabs 78 within the sheath 60. In the embodiment shown in FIGS. 6-8, the same process may be used with the single flexible rim 79.

Figure 10:
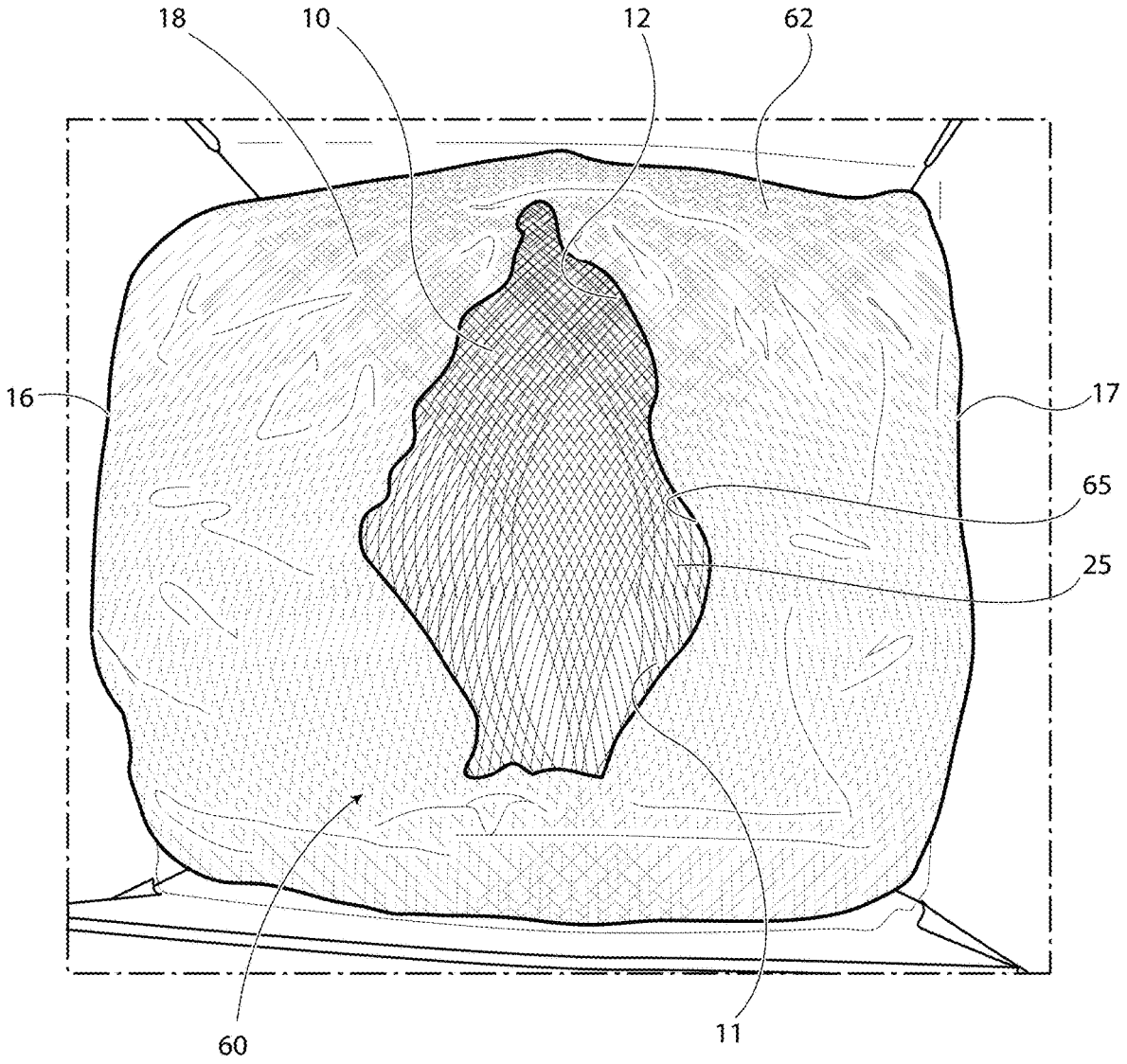
FIG. 10 is a perspective view of a welding wire package according to another embodiment of the invention.
Figure 11:
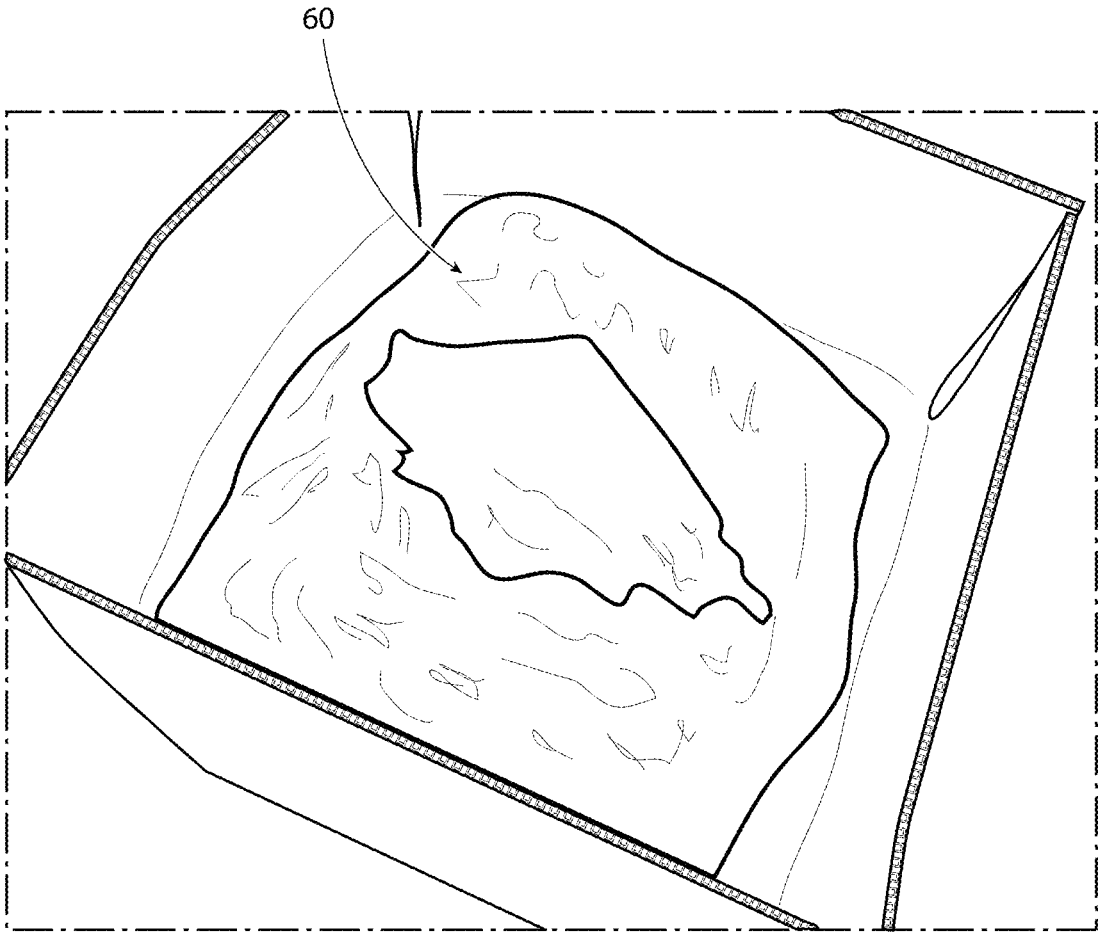
FIG. 11 is a perspective view similar to FIG. 10, where all of the wire within the package has been paid off.

Optionally, when forming the welding wire package 50 as described above, a separator 30 may be incorporated into the package 50. According to one embodiment, separator 30 is placed on the outer surface 14 of coil 10 over gap 25 before the coil 10 is removed from mandrel 110. The sheath 60 is applied over coil 10 and separator 30 to integrate the separator 30 within sheath 60. Separator 30 may have an opening 34 therein that allows payout of the wire W from inside the coil 10. The sheath material may be cut away from opening 34 to permit the payoff end of wire W to be drawn outward from coil 10. Alternatively, when using spiral wound tape 62 to form sheath 60, the winding process for tape 62 may be performed in the same pattern as the winding of the coil 10 such that an opening 65 is formed in sheath 60 corresponding to gap 25 in coil 10 (FIG. 10). In this instance, separator 30 may be incorporated in an additional layer of sheath material wound over separator 30, or separator 30 may be attached in a separate operation, for example, by tape or other fasteners that attach separator 30 to sheath 60. In the embodiment shown in FIG. 9, separator 30 is fully incorporated within the sheath 60 by winding tape 62 over coil 10 and separator 30 so that separator 30 becomes a structural component in the package that provides support within gap 25.

Figure 15:
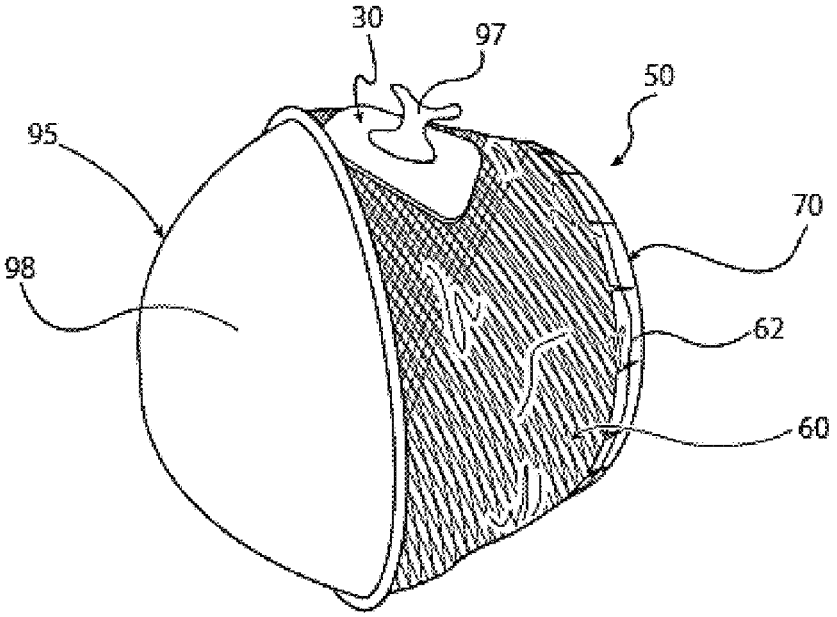
FIG. 15 is a partially cutaway perspective view showing details of an alternative embodiment including a core support within the welding wire package to internally support the coil.
Figure 16:
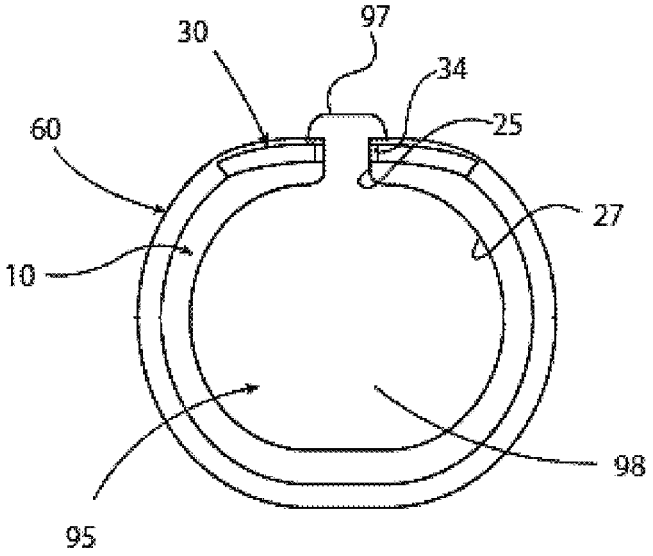
FIG. 16 is a sectioned end view of the welding wire package shown in FIG. 15.

In accordance with another alternative embodiment shown in FIGS. 15 and 16, internal support may be provided to the coil 10 as part of the welding wire package 50. A core support, generally indicated by the number 95, may be placed within core 27 and engage at least a portion of the inner surface 15 of coil 10. Core support 95 may be provided within the coil 10 before or after it is removed from mandrel 110. In the example shown, core support is provided within the core 27 of coil 10 after coil 10 is removed from the mandrel 110, as discussed more completely below.

Core support 95 may include an inner wrap or film that adheres to inner surface or is otherwise attached to inner surface 15 of coil 10. Alternatively, core support 95 includes a member or plural members that provide support by applying pressure to the interior of the coil including but not limited to mechanical members that may be compressed to be inserted within the core and expand once inside to apply a biasing force against at least a portion of the interior surface, such as resilient members, telescoping members with an internal spring or fluid biasing mechanism, and the like. Materials that expand within the core 27 as a result of a chemical reaction, such as foaming materials may also be suitable. In the example shown, a dunnage bag, including but not limited to inflatable bags constructed of rubber, polymer material, paper material, and the like can also be used. For example, dunnage bag may include a balloon that is inserted within the core in a partially inflated or uninflated state, and then inflated to apply pressure to inner surface 15. To that end balloon 98 may be inserted through gap 25. Balloon 98 may be of any size or shape suitable for engaging at least a portion of inner surface 15 and multiple balloons 98 may be provided within core 27 to provide support for coil 10 or apply pressure to inner surface 15. In the example shown, a single balloon having an inflated dimension that is larger than at least one dimension of core 27 so that upon inflation, balloon 98 engages inner surface 15 along at least a portion thereof. Such engagement is believed to improve the stability of wire coil 10 and assist in preventing wire turns within the coil from shifting or sliding relative to each other. To facilitate release of the turns from coil from inner surface 15 once the welding wire package 50 is at a job site, balloon 98 may be deflated and/or removed. It will be appreciated that it will not always be necessary to remove the balloon. For example, balloon or balloons may be attached to end forms 70 such that they would not interfere with the pay off of wire from coil 10.

To facilitate inflation of balloon 98 within core 27, balloon 98 may be inserted through gap 25 after coil 10 is removed from mandrel 110 and after sheath 60 is in place. If separator 30 has been provided within sheath 60, balloon 98 may be inserted through opening 34 in separator 30. If balloon 98 has a nozzle 97 or other portion where balloon 98 is inflated, this portion may be located near gap 25 or opening 34 so that nozzle 97 is easily accessed for inflation and deflation purposes. Indeed, a portion of nozzle 97 may extend externally of coil 10 so that it is accessible by the user at the job site to deflate and remove balloon 98. For example a portion of nozzle 97 may extend outward of opening 34 to allow inflation of balloon 98. Once balloon 98 is inflated, this portion may be tied off, sealed, or a clamp applied to maintain balloon 98 in the inflated state. If a valve is provided, the valve would be closed to achieve the same effect. The portion of nozzle 97 could then be secured near opening 34 to facilitate access at job site. As a further alternative, an opening may be provided in one or both of the end forms 70 to facilitate inflation, deflation, and or removal of the balloon. Alternatively, when no portion of the balloon 98 extends externally of coil 10, an instrument may be inserted through opening 34 or gap 25 to puncture balloon 98 and deflate it.

Although the subject innovation has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (e.g., enclosures, sides, components, assemblies, etc.), the terms (including a reference to a "means") used to describe such elements are intended to correspond, unless otherwise indicated, to any element which performs the specified function of the described element (e.g., that is functionally equivalent), even though not structurally equivalent to the disclosed structure which performs the function in the herein illustrated exemplary embodiment or embodiments of the innovation. In addition, while a particular feature of the innovation may have been described above with respect to only one or more of several illustrated embodiments, such feature may be combined with one or more other features of the other embodiments, as may be desired and advantageous for any given or particular application. Although certain embodiments have been shown and described, it is understood that equivalents and modifications falling within the scope of the appended claims will occur to others who are skilled in the art upon the reading and understanding of this specification.

In addition, while a particular feature of the subject innovation may have been disclosed with respect to only one of several implementations, such feature may be combined with one or more other features of the other implementations as may be desired and advantageous for any given or particular application. Furthermore, to the extent that the terms "includes," "including," "has," "contains," variants thereof, and other similar words are used in either the detailed description or the claims, these terms are intended to be inclusive in a manner similar to the term "comprising" as an open transition word without precluding any additional or other elements.

What is claimed:

1. A welding wire coil package for a coil of wire wound on a mandrel, the welding wire coil package comprising:

a sheath that is configured to be laid over the coil of wire where the sheath includes at least one layer of material that is configured to adhere to the coil of wire to hold the coil of wire in a position that the coil of wire was formed and prevent unintended movement of the coil of wire, the sheath defining a first opening configured to allow wire from an interior surface of the coil of wire to be paid out through; and a first end form configured to be located at a first end of the coil of wire and a second end form configured to be located at a second end of the coil of wire, wherein each end form includes:

an edge portion defining a mandrel receiving opening, the edge portion being adapted to abut an end of the coil of wire, and an extended element that extends radially outward from the edge portion, and wherein the extend element further extends axially outward from the edge portion along a longitudinal axis extending through a center of the first end form and a center of the second end form, wherein the sheath is configured to at least partially overlay the extended element of at least one of first end form or the second end form to attach the at least one of the first end form or the second end form to the sheath, and wherein the welding wire coil package includes a pair of hubs and at least one shaft, wherein the hubs are configured to be respectively attached to the first end form and the second end form.

2. The welding wire coil package of claim 1, wherein the sheath is constructed of a strip of cellophane material that is configured to spirally wind about the coil of wire, the strip having an adhesive on an inner surface thereof.

3. The welding wire coil package of claim 2, wherein the strip has a width of about 2 inches.

4. The welding wire coil package of claim 1, comprising a separator, wherein the separator is configured to be placed in a gap defined by the coil of wire.

5. The welding wire coil package of claim 4, wherein the separator defines a third opening that is configured to communicate with a core of the coil of wire.

6. The welding wire coil package of claim 5, wherein the separator includes an insert extending radially inward therefrom.

7. The welding wire coil package of claim 6, wherein the separator includes a plate defining the third opening and the insert includes a tube extending inward from the plate, the tube defining a passage that communicates with the third opening to permit a payoff end of the coil of wire to be withdrawn from the interior surface of the coil of wire and exit the coil of wire through the passage and the third opening.

8. The welding wire coil package of claim 5, wherein the separator has a diamond shape.

9. The welding wire coil package of claim 1, further comprising a core support configured to be inserted within a core of the coil of wire, the core support being expandable to contact the interior surface of the coil of wire.

10. The welding wire coil package of claim 9, wherein the core support is a balloon.

11. The welding wire coil package of claim 1, wherein at least one of the first end form or the second end form includes a cylindrical surface.

12. The welding wire coil package of claim 1, wherein the first end form and the second end form connect with the sheath and are configured to axially restrain the coil of wire.

13. The welding wire coil package of claim 1, wherein the at least one layer of material of the sheath includes at least one of a polymer film, a pulp material, a textile material, or a fiber reinforced tape.

14. The welding wire coil package of claim 1, wherein at least one of the first end form or the second end form is configured to be attached to a support frame to facilitate transport and handling of the coil of wire.

* * * * *